US006491762B1

(12) United States Patent
Bundy et al.

(10) Patent No.: US 6,491,762 B1
(45) Date of Patent: Dec. 10, 2002

(54) METHOD FOR REMOVAL OF CURED FILMS FROM COOKWARE AND BAKEWARE PRODUCTS

(76) Inventors: Gilbert L. Bundy, 5199 Stratford Ave., Powell, OH (US) 43065; Bradley S. Moore, 854 Babbington Ct., Westerville, OH (US) 43081

( * ) Notice: Subject to any disclaimer, the term of this patent is extended or adjusted under 35 U.S.C. 154(b) by 35 days.

(21) Appl. No.: 09/635,382

(22) Filed: Aug. 9, 2000

Related U.S. Application Data

(60) Provisional application No. 60/148,052, filed on Aug. 10, 1999.

(51) Int. Cl.[7] ..... B08B 1/02; B08B 3/02; B08B 9/00

(52) U.S. Cl. ..... 134/23; 134/22.18; 134/24; 134/25.1; 134/25.2; 134/25.4; 134/25.5; 134/32; 134/36; 134/38

(58) Field of Search ..... 134/22.18, 23, 134/24, 25.1, 25.2, 25.4, 25.5, 32, 36, 38, 172; 427/140

(56) References Cited

U.S. PATENT DOCUMENTS 4,018,623 A * 4/1977 Walker ..... 134/21
5,942,045 A * 8/1999 Raghavan et al. ..... 134/34

* cited by examiner

*Primary Examiner*—Zeinab El-Arini
(74) *Attorney, Agent, or Firm*—Robert R. Lech; Thomas E. O'Connor, Jr.; Calfee, Halter & Griswold, LLP

(57) ABSTRACT

A method for removing non-stick coatings from cookware or bakeware products is disclosed. The method includes the step of determining the angles of the primary surfaces of a pan having a coating to be removed. The method further includes the step of configuring a high-speed, multiport, rotating cleaning head to provide at least one water jet associated with each primary surface. The method further includes the step of employing the cleaning head to deliver an ultra-high pressure water jet directed at the pan while tracking the cleaning head along a plane substantially parallel to the upper surface of the pan. Using the method of the present invention, a coating may be removed from a pan in a single pass.

6 Claims, 3 Drawing Sheets

METHOD FOR REMOVAL OF CURED FILMS FROM COOKWARE AND BAKEWARE PRODUCTS

CROSS-REFERENCE TO RELATED APPLICATION

This application is a continuation of U.S. Provisional Patent Application serial No. 60/148,052 filed Aug. 10, 1999.

BACKGROUND OF THE INVENTION

1. Field of the Invention

This invention relates to the field of refurbishing of non-stick polymer-coated bake ware and cookware products.

2. Background Art

In the field of commercial cookware and bakeware, many products employ non-stick and other release-enhancing coatings (including silicone-based glaze, rubberized silicones, and flourocarbon polymer coatings such as PTFE's, PFA's, and FEP's). After such commercial cookware and bakeware products have been repeatedly used and consequently experience wear, it is desirable to be able to remove such coatings from the products so that a new coating of the fluorocarbon polymer (or other similar silicone-based or polymer coating) can be applied to refurbish old product. This process is desirable so that:

1. production rejects can be reworked, thereby reducing scrap, and
2. pans can be recoated, extending the life of the pans.

The second purpose has significant economic and financial implications within the baking industry.

A suitable technology would have to be effective, economical, safe, environmentally friendly and commercially viable. Prior art processes, including grit blasting, shot peening, high temperature oven burning and molten salt bath immersion did not meet the criteria needed to ake "stripping"a viable process.

SUMMARY OF THE INVENTION

The process of the instant invention solves the problem of removing coatings using water cutting technology.

In order to remove the old coating water pressure exceeding 35 KPSI and a special swivel multi-port, high speed rotating cleaning head are utilized. This head had to be made to exacting dimensions so that when rotating it would properly sweep and strip the coating from the recessed areas of bakeware or cookware products employing water jets that are angled to correspond with the primary angles of the surfaces of the cookware or bakeware product to be cleaned. Proper use of such a cleaning head enables a cookware or bakeware product to be cleaned in a single pass.

The first generation of cleaning heads that may be used with the present invention includes a configuration utilizing four sapphire orifices or jewels. Two of the orifices are 0.008 inches and should be angled at 21° and 25°. The other tow orifices are 0.005 inches angled at 21° and 25°. The head is stainless steel and must rotate at a minimum of 500 rpm. It is driven by compressed air.

The preferred head configuration, as described in more detail with reference to FIG. 2, includes seven nozzle positions, each of which may be plugged or fitted with a removable nozzle head. Each removable nozzle head may have an orifice sized between 0.0001 and 0.25 inches in diameter. The head is stainless steel and rotates at approximately 1600 rpm. It is driven by compressed air.

Selection of process variables are key to the present invention. Key process variables (is additional to head design) include: head standoff, tracking, speed and tracking overlap.

Each bakeware or cookware product has unique removal requirements. Process variables must be changed so that the proper level of removal can be efficiently achieved.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION

Figure 1:
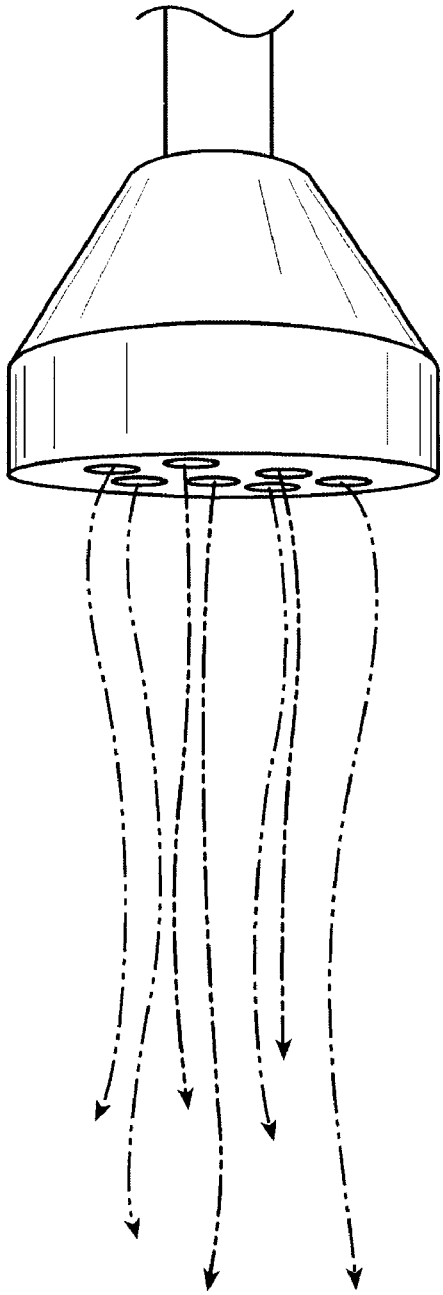
FIG. 1 is an illustration of a cutting head which may be used in the process of the present invention.

Operation of the inventive system is generally described above. Other details are as follows:

1.0 Intensifier Pump

A pump such as the Jet Edge Model 55-150 Intensifier Pump uses two hydraulically-operated intensifier assemblies to provide a consistent supply of ultra-high pressure (UHP) water at 55,000 psi (3800 bar). A 150 horsepower motor delivers up to 2.9 gallons per minute for a variety of cutting or cleaning tools.

1.1 Hydraulic Circuit

The intensifier pump utilizes an axial piston, variable displacement, pressure compensated type hydraulic pump which has a factory set maximum output pressure of 3000 psi. The pump operating pressure is controlled through the use of a proportional relief valve. The pump is driven by a high efficiency, totally enclosed, fan cooled (TEFC) electric motor with wye-delta "soft start" to ensure high reliability, long service life and minimal energy usage.

Hydraulic fluid is filtered to 10 microns through a full flow filter assembly to extend service life of the components. The filter assembly is equipped with a bypass valve, a pop-up visual indicator, and an electronic sensor to indicate when the filter requires service.

Hydraulic fluid is cooled by the use of heat exchangers. Water flows through internal tubes in the heat exchangers to cool the fluid. Hydraulic fluid exiting the intensifier manifold flows through a filter and then the primary heat exchanger. When the machine is in static mode (intensifiers not running) the fluid in the case drain circuit is cooled by a secondary heat exchanger.

The system utilizes a nitrogen-charged accumulator that helps maintain consistent hydraulic fluid volume. The accumulator also minimizes any fluctuations or pulsations in the hydraulic fluid caused by the hydraulic piston reciprocating in the cylinder.

1.2 Low Pressure Process Water Circuit

The on-board Water Prefilter and Pressure Booster provides 80–100 psi of pretreated, filtered water to the water inlet on the intensifier cylinders. Water filters on the incoming water supply line remove impurities down to 0.45 micron before they reach the intensifier.

A pressure switch is integrated in the water supply line to ensure adequate water flow to the intensifier is maintained. If the pressure drops below a predetermined set point, a switch energizes a relay to stop intensifier operation.

1.3 Low Pressure Cooling Circuit

The water modulating valve automatically regulates the volume of water sent through the cooling circuit by means of an adjustable thermostatic coil. Coolant water to the heat exchangers maintains the hydraulic fluid temperature below 120° (49° C.).

Solenoid-operated valves control water flow to the low pressure water supply and coolant lines. The closed valves prevent a continual flow of water through the lines when the equipment is not running.

1.4 Ultra-High Pressure Water Circuit

The intensifier acts as an amplifier using the energy from low pressure hydraulic fluid to convert low pressure water into UHP water. The pressure-compensated hydraulic system, operating at 300 psi, use electronically shifted, plunger-style intensifiers operating at an intensification ratio of 19.1 to generate 55,000 psi of UHP water.

A hydraulic pump, driven by an electric motor, is used to transfer and pressurize hydraulic fluid from the reservoir to the intensifier manifold. Solenoid-controlled spool valves are used to direct the hydraulic fluid from the manifold to the intensifier. The pressurized hydraulic fluid is alternatively applied to each side of the intensifier creating a reciprocating motion within the intensifier. When the intensifier is on an inlet stroke, water is allowed to flow into a high pressure cylinder through an inlet check valve. The electronic controls sense when he intensifier has reached the end of its stroke and sends a signal to the spool valve to reverse hydraulic flow. The motion of internal components of the intensifier are now pressurizing the water captured in the high pressure cylinder on the inlet stroke. The pressurized water is forced out of the high pressure cylinder through a high pressure check valve and sent through an alternator.

The alternator dampens the pressure fluctuations caused by the reciprocating motion to provide a steady stream of UHP water. The Leak Before Break (LBB) alternator design will signal when servicing is required to ensure alternator failure does not occur.

Each intensifier pump has a high pressure seal leakage collection block. The collection block allows the operator to visually check for any seal leakage in a single location. All seal locations are marked on the collector and allow the operator to easily determined which seal may require service.

Weep holes throughout the UHP water system will reveal water seepage if a component requires service. The weep holes allow the operator to determine when service is required on any seals, seats or fittings.

All pumps include a high pressure safety bleed-down valve for relieving ultra-high pressure water from the system. This normally open-valve actuates any time the pump is turned off, the intensifiers are turned off or if a system E-Stop is activated.

1.5 Electrical Control System

A programmable logic controller (PLC) monitors and controls all machine functions and automatically energizes relays to light the warning lamps in the event of potentially detrimental conditions. All timing, operation, sensing, and response circuits are routed through the PLC.

The NEMA 12/13 rated electrical enclosure provides protection for electrical components. The enclosure is mounted directly to the frame and houses components such as motor starters, power supplies, transformers, PLC, breakers, overloads, and relays.

2.0 Gantry Motion System

An X-Y coordinate cutting systems is specifically designed for waterjet and abrasivejet (waterjet) cutting. The systems are designed for operation in the harsh environment, ease of operation, minimal maintenance, high reliability, close accuracy and long reliable life.

2.1 Mechanical Systems Structure

The machine frame is a steel structure designed for rigidity and accuracy. Weldments are heat stress relieved prior to machining to assure stability of the finished part.

The dynamic beams, and those in excess of six foot travel, are a welded honeycomb structure to further enhance rigidity while reducing weight. The lower weight is critical to enable the system to perform well dynamically.

The structure is protected with two part epoxy paint. Surface preparation is sandblasted followed by primer and then a finish coat.

Non-ferrous metals are protected with coatings as necessary to prevent corrosion or galvanic actions.

Linear Ways

The axes are supported on recirculating ball-type linear ways. The ways are sized to yield over thirty years of service at two shifts per day operation.

Power Transmission

The axes are driven with ball screws. Each ball screw linear position is maintained with precision duplex pair factory ground and matched bearing sets. The ball nuts are the dual preloaded type for the X and Y axes. The side axis employs two lead screws coordinated by the control system. A servoed Z axis uses a single close tolerance ball nut. A brake is used to prevent movement of the Z carriage due to gravity. A motorized but non-servoed Z (standard) employs an Acme screw and DC gear motor. This eliminates the need for a brake.

Machine Protective Covers

All mechanical components are protected from the harsh waterjet environment. The Z-axis employs small round sealed bellows. The two major axes use a revolutionary lip seal system. This system uses brushes, labyrinth passages, neoprene lip seals and high volume, low pressure filtered air to protect the critical components of motion.

A complete set of lip seals is less than $600.00 installed. This compares to $6,000.00 without installation for four sided bellows type seals for a 4'×8'system. Lip seals will last ten to twenty times as long as bellows in the abrasive environment.

Wireways For Moving Electrical Conductors

All moving wireways are located inside of the machines protective covers. This prevents premature wire and/or flexible way failure doe to abrasion from the cutting media. It also makes the equipment much easier to keep clean and operational.

High Pressure Plumbing

The high pressure water is conveyed to the cutting head via an overhead broken-arm mechanism. The support mechanism supports the high pressure tubing. This eliminates high stresses due to bending flexure as seen with a whip type plumbing system. Therefore, tubing failures are virtually non-existent. The abrasive feed line also gets mounted to this mechanism. This eliminates dragging the abrasive feed line around and over the work areas.

Catcher Tank

The catcher tank employs a grid structure to support the material at 34 inches above the floor. Removal of the spent abrasives and the kerf material can be automatic. However, the basic "dig" style tank collects the solids in the tank passing excess water over a built in weir to be routed to your drain.

2.2 Control System

Base Control System

The standard control system is an Allen-Bradley Model 9/230. X-Ys with programmable Z axis use an Allen-Bradley 9/260 Control System with level 31 options. The control is a 32 bit processor with 60,000 bytes RAM for part program storage at the control. This is expandable to 190,000 bytes.

Hand Held Pendant

The hand held pendant allows the operator to move about the cutting area for Z-height adjustments during set-up and operation. It also has a motion stop button to help the operator process orders correctly.

Servo Drives

The amplifiers are 15 amp output units mounted in a four axis chassis. The amplifiers drive forty NLB D.C. Servo Motors in a velocity feed back mode. The motors are direct coupled to the lead screws. This gives the most accurate operation by eliminating any compliance as seen in systems with belt drives between the lead screws or lead nuts. Positioning is obtained from encoders on the motors. The encoders are operated in Quadature mode for the best accuracy.

Control Enclosure

A stand alone Nema 12 enclosure 24×30×72 inches is standard. The CRT and front panel are mounted in the door for easy access. An optional 1200 BTU/hr air conditioning unit maintains correct temperature inside the enclosure when operated in high temperature environments.

3.0 Cleaning Head

An ultra-high pressure (UHP) pump provides pressurized water to the cutting head shown in FIG. 1. The water is directed through a sapphire orifice resulting in a water stream that can cut through and clean a wide variety of materials.

Water flow is controlled by a needle valve, which is normally kept closed by a spring loaded plunger in the air cylinder. Plant-supplied compressed air is controlled by a solenoidoperated pneumatic valve. When the solenoid valve opens, air pressure is introduced to the air chamber of the cutting head. The air pressure shifts the needle valve assembly, thereby enabling the water to flow through.

When the needle valve shifts, incoming water flows through the orifice. When the air pressure is exhausted, the spring in the air cylinder extends a plunger, closing the needle valve and stopping water flow.

4.0 Water Requirements

Intensifier

The water supplied to the intensifier is critical to waterjet cutting due to its direct influence on the service life of equipment components such as check valves, seals and the sapphire orifices that shape the cutting stream. A high concentration of total dissolved solids (TDS) causes accelerated wear of these components due to the inherent abrasiveness of the water.

As part of installation planning, a water quality analysis should be performed by a commercial company that specializes in water conditioning equipment . A water purification supplier should be consulted to supply the most suitable equipment for specific condition. The minimum information that should be supplied regards Total Dissolved Solids (TDS) silica content and pH value.

Inlet water should be treated for either the removal of hardness of the reduction in TDS. Water softening is an ion exchange process that removes scale forming minerals such as calcium. TDS reduction can be accomplished with either deionizing (DI) or reverse osmosis (RO) equipment. Generally, DI or RO provides better component life than water softening.

The best treatment process for specific application is a function of the original water quality and desired service life of affected components. A water treatment producing TDS content of less than 0.5 ppm is not recommended since the aggressiveness of the purified water may damage the pump components.

WATER TREATMENT GUIDELINES:

| | | Recommended Treatment |
|---|---|---|
| Total Dissolved Solids (TDS) | Low TDS (<100 ppm) | Considered good water quality. Can be treated by softening. |
| | Moderate TDS (100–200 ppm) | Can be treated by softening or TDS reduction (RO or DI). |
| | High TDS (>200 ppm) | Considered poor water quality. Should be treated with RO or DI. |
| Silica Content | High content (>15 ppm) | Dual Strong Base DI |
| pH Value | Treated water must have a value of 6 to 8. | |

In addition to the treatment described above, the water must be filtered for the removal of suspended particulates. Water should be filtered to 0.5 microns absolute. Jet Edge manufactures a Water Prefilter and Pressure Booster System that meets the necessary requirements. The initial water supply should be at least 5 gpm (19 lpm) at 40 psi (2.8 bar). The water pressure is boosted by a small pump to the 80 psi (5.5 bar) required by the intensifier and has replaceable filters that successively remove particles to 10, 1 and 5 microns.

Heat Exchanger

The heat exchanger uses regular tap water for cooing the hydraulic fluid. Fluid temperature must be maintained below 120° F. (49° C.). A consistent water flow of 5 to 12 gpm (19 to 45 lpm), depending on pump model, is required at an inlet temperature not exceeding 70° F. (21 C.). Public utility water is usually acceptable for cooling purposes, In situations where water contains heavy mineral deposits, the exchanger tubes may eventually become restricted by particle buildup. If this is a chronic problem, prefiltration and/or softening may be necessary. Depending on plant setup, ambient temperature can also be a factor in cooling. Additional cooling may be required if the equipment is confined to a small, high-temperature space.

5.0 Operational Example

Figure 2:
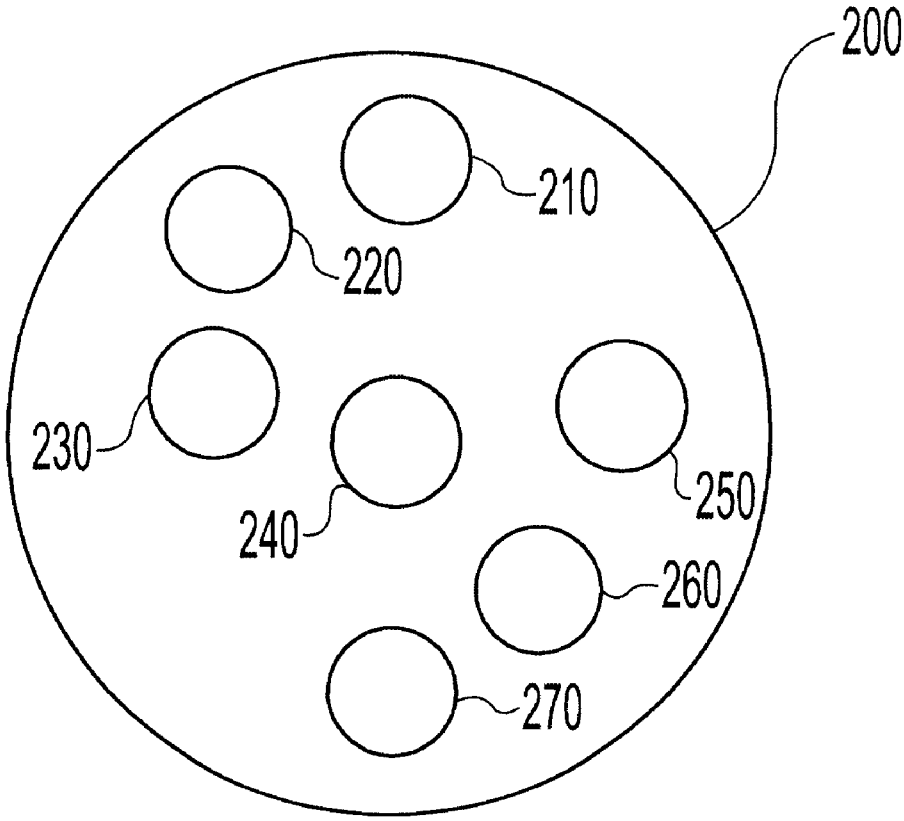
FIG. 2 is an illustration of a preferred nozzle configuration of the cutting head of FIG. 1.

Referring now to FIG. 2, there is illustrated a cleaning head configuration 200 which is preferred for the method of the present invention. The configuration 200 includes seven nozzle positions 210–270, each of which may be plugged or fitted with a removable nozzle head. Each removable nozzle head defines an orifice having a diameter of between 0.0001 inch and 0.25 inches. Further, each nozzle position may be machined to direct a water jet at a particular angle between 0 and 90 degrees of the center axis of the cleaning head. Alternatively, the removable nozzle could be machined to provide redirection of a water jet, again at any angle between 0 and 90 degrees of the center axis of the cleaning head.

The selection of nozzle orifice and angulation will vary depending on the geometry of the cookware or bakeware product to be cleaned. The method of the present invention includes determining the angles of the primary surfaces of the product to be cleaned. The nozzles of the cleaning head should be configured to provide a water jet to clean a primary surface. For each primary surface of the product to be cleaned, the cleaning head will preferably have at least one associated nozzle with an angle of between 65 and 90 degrees relative to the surface to be cleaned.

Once the primary angles of the surfaces of the product to be cleaned have been determined, and the cleaning head has been appropriately configured, the head must be employed to deliver the water jets to the cookware or bakeware product. This is accomplished by tracking the cleaning head along a plane substantially parallel to the upper surface of the product being cleaned. Preferably, the path of the cleaning head is directed such that the center of the cleaning head passes directly over the center of every cup formed within the cookware or bakeware product. Testing has revealed that the preferred standoff distance between the cleaning head and the upper surface of the product is between 0.25 and 1.5 inches at a water pressure of 55 KPSI.

Figure 3:
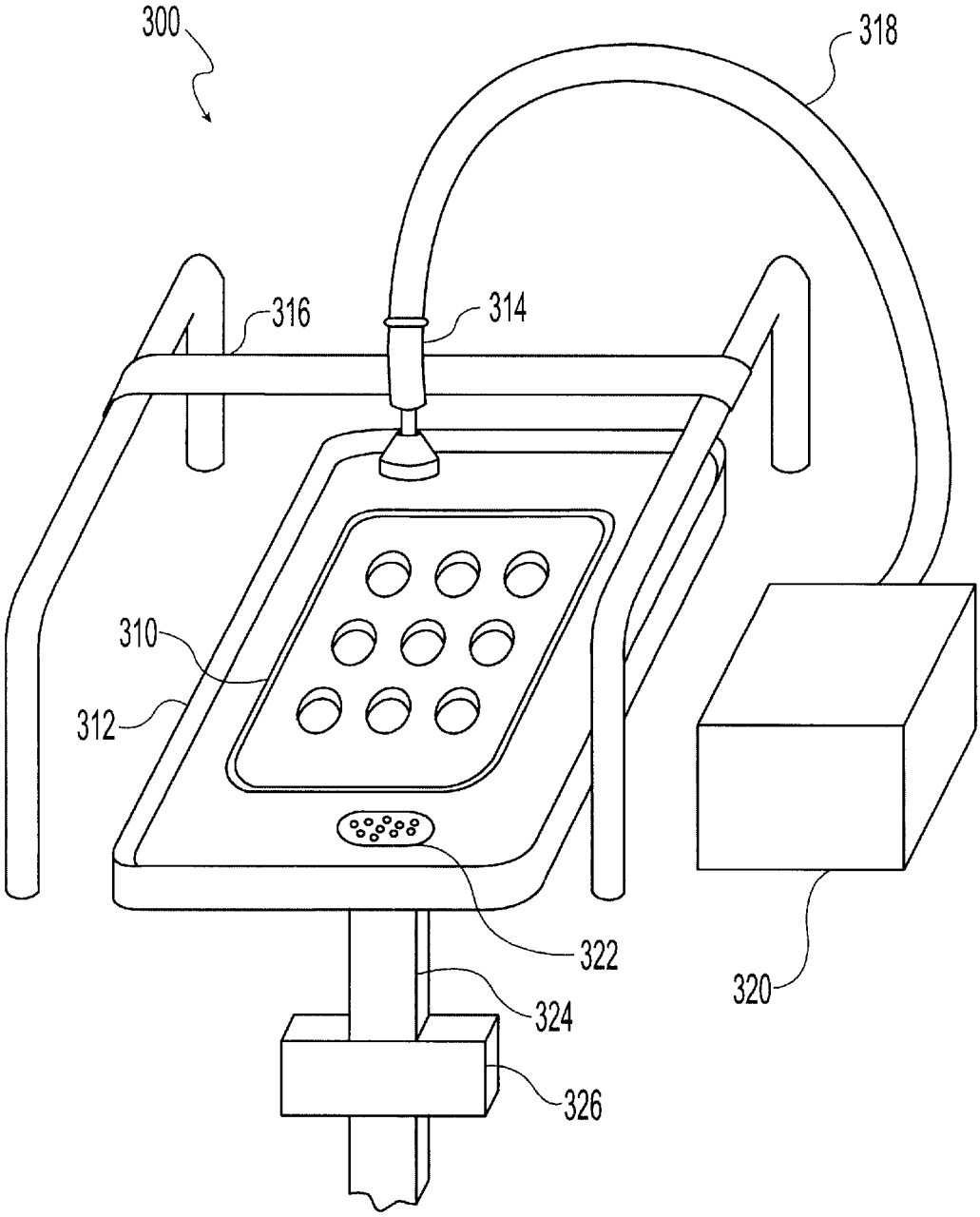
FIG. 3 is an illustration of a cleaning station which may be used to perform the method of the present invention.

Referring now to FIG. 3, there is illustrated a cleaning station 300 which may be used to implement the process of the present invention. The cleaning station 300 includes a baking pan 310 to be cleaned. Baking pan 310 is merely exemplary and could be any type of cookware or bakeware product. Baking pan 310 is positioned above catcher tank 312. Catcher tank 312 is designed to capture the excess water and debris that results from a water jet cleaning operation. The water and debris flow through drain 322, down drain pipe 324 and are filtered by filter 326.

Baking pan 310 should be positioned relative to gantry 316 such that the plane of the upper surface of pan 310 is substantially parallel to the X-Y plane of gantry 316. Gantry 316 is preferably computer controlled and moves cleaning head 314 on a linear fashion along the X-Y plane. Cleaning head 314 delivers at least one cleaning waterjet to the surface of pan 310. The water us delivered to cleaning head 314 through hose 318 from UHP pump 320.

Of course, it will be recognized by one of ordinary skill that there are many variations of the cleaning station which will accommodate the method of the present invention. For example, the cleaning head could be disposed underneath the pan to be cleaned, instead of above it. The cleaning head could be held stationary, and the pan could be tracked relative to the head, such as through the use of a conveyor. Further, the method of the present invention is not limited to a single cleaning head, and multiple cleaning head could certainly be employed without exceeding the scope of the present invention.

From the above description of the invention, those skilled in the art will perceive improvements, changes and modifications in the invention. Such improvements, changes and modifications within the skill of the art are intended to be covered by the appended claims.

Accordingly, it is to be understood that the drawings and description in this disclosure are proffered to facilitate comprehension of the invention, and should not be construed to limit the scope thereof. It should be understood that various changes, substitutions and alterations can be made without departing from the spirit and scope of the invention as defined solely by the appended claims.

What is claimed is:

1. A method for removing a coating from a cookware or bakeware pan, including:

determining angles corresponding to primary surfaces of a pan having a coating to be removed;

configuring a high-speed, multi-port, rotating cleaning head to provide at least one water jet associated with each primary surface; and employing the cleaning head to deliver an ultra-high pressure waterjet directed at the pan while tracking the cleaning head along a plane substantially parallel to an upper surface of the pan, thereby removing the coating from the pan.

2. The method of claim 1, further including:

positioning the cleaning head such that the standoff between the cleaning head and the upper surface of the pan is between 0.25 and 1.5 inches.

3. The method of claim 1, wherein the pan includes a plurality of cups, and tracking includes passing the center portion of the cleaning head substantially over a center portion of each of the plurality of cups.

4. The method of claim 1, wherein the cleaning head is disposed below the pan.

5. The method of claim 1, wherein the cleaning head is one of a plurality of cleaning heads.

6. The method of claim 1, wherein the pan is disposed on a conveyor.

* * * * *